US006986255B2

(12) United States Patent
Smith et al.

(10) Patent No.: US 6,986,255 B2
(45) Date of Patent: Jan. 17, 2006

(54) PILOTED AIRBLAST LEAN DIRECT FUEL INJECTOR WITH MODIFIED AIR SPLITTER

(75) Inventors: Clifford E. Smith, Madison, AL (US); Daniel A. Nickolaus, Huntsville, AL (US)

(73) Assignee: Rolls-Royce PLC, Derby (GB)

( * ) Notice: Subject to any disclaimer, the term of this patent is extended or adjusted under 35 U.S.C. 154(b) by 333 days.

(21) Appl. No.: 10/278,922

(22) Filed: Oct. 24, 2002

(65) Prior Publication Data

US 2004/0079086 A1 Apr. 29, 2004

(51) Int. Cl.
*F02C 7/22* (2006.01)
*F02C 7/26* (2006.01)

(52) U.S. Cl. ..... 60/776; 60/737; 60/739; 60/746

(58) Field of Classification Search ..... 60/776, 60/39.27, 39.24, 737, 738, 739, 740, 746, 60/747, 748
See application file for complete search history.

(56) References Cited

U.S. PATENT DOCUMENTS 3,937,011 A * 2/1976 Caruel et al. ..... 60/737
4,389,848 A * 6/1983 Markowski et al. ..... 60/738
5,224,333 A * 7/1993 Bretz et al. ..... 60/740
5,423,173 A * 6/1995 Lemon et al. ..... 60/776
5,505,045 A * 4/1996 Lee et al. ..... 60/748
5,941,075 A * 8/1999 Ansart et al. ..... 60/748
5,966,937 A * 10/1999 Graves ..... 60/748
6,272,840 B1 8/2001 Crocker et al.
6,381,964 B1 * 5/2002 Pritchard et al. ..... 60/746
6,453,660 B1 * 9/2002 Johnson et al. ..... 60/39.821
6,546,732 B1 * 4/2003 Young et al. ..... 60/772
6,708,498 B2 * 3/2004 Stickles et al. ..... 60/776
2002/0162333 A1 * 11/2002 Zelina ..... 60/776
2003/0131600 A1 * 7/2003 David et al. ..... 60/737
2005/0028526 A1 * 2/2005 Von Der Bank ..... 60/748

* cited by examiner

*Primary Examiner*—Justine R. Yu
*Assistant Examiner*—William H. Rodriguez
(74) *Attorney, Agent, or Firm*—Oliff & Berridge, PLC

(57) ABSTRACT

A fuel injector system that reduces and/or eliminates combustion instability. The fuel injector system includes a pilot fuel injector, a pilot swirler that swirls air past the pilot fuel injector, a main airblast fuel injector having an aft end, inner and outer main swirlers that swirl air past the main airblast fuel injector, and an air splitter located between the pilot swirler and the inner main swirler. The air splitter includes at least one aft end cone angled radially outboard and axially positioned downstream of the main airblast fuel injector aft end. The air splitter divides a pilot air stream exiting the pilot swirler from an inner main air stream exiting the inner main swirler to create a bifurcated recirculation zone.

22 Claims, 3 Drawing Sheets

PILOTED AIRBLAST LEAN DIRECT FUEL INJECTOR WITH MODIFIED AIR SPLITTER

BACKGROUND OF THE INVENTION

1. Field of Invention

The present invention relates generally to fuel injection assemblies for gas turbine engines.

2. Description of Related Art

There is a continuing need, driven by environmental concerns and governmental regulations, for improving the efficiency of and decreasing the emissions from gas turbine engines of the type utilized to power jet aircraft or generate electricity. Particularly, there is a continuing drive to reduce nitrous oxide ($NO_x$) emissions.

Advanced gas turbine combustors must meet these requirements for lower $NO_x$ emissions under conditions in which the control of $NO_x$ generation is very challenging. For example, the goal for the Ultra Efficient Engine Technology (UEET) gas turbine combustor research being done by NASA is a 70 percent reduction in $NO_x$ emissions and a 15 percent improvement in fuel efficiency compared to ICAO 1996 STANDARDS TECHNOLOGY. Realization of the fuel efficiency objective will require an overall cycle pressure ratio as high as 60 to 1 and a peak cycle temperature of 3000° F. or greater. The severe combustor pressure and temperature conditions required for improved fuel efficiency make the $NO_x$ emissions goal much more difficult to achieve.

One approach to achieving low $NO_x$ emissions is via a class of fuel injectors known as lean direct injectors (LDI), such as LDI injector 10 shown in FIG. 4. Lean direct injection designs seek to rapidly mix the fuel and air to a lean stoichiometry after injection into the combustor. If the mixing occurs very rapidly, the opportunity for near stoichiometric burning is limited, resulting in low $NO_x$ production.

Conventional fuel injectors that produce low $NO_x$ emissions at high power conditions, such as LDI injector 10 shown in FIG. 4, have several disadvantages, including for example, the potential for excessive combustion dynamics or pressure fluctuations caused by combustion instability. Combustion instability occurs when the heat release couples with combustor acoustics such that random pressure perturbations in the combustor are amplified into large pressure oscillations. These large pressure oscillations, such as those pressure oscillations having amplitudes of about 1–5% of the combustor pressure, can have catastrophic consequences, and thus, must be reduced and/or eliminated.

SUMMARY OF THE INVENTION

This invention provides fuel injector systems that enable improved combustion efficiencies and reduced emissions of pollutants, particularly $NO_x$ emissions and carbon monoxide (CO) emissions;

This invention also provides fuel injector systems for gas turbine engines which result in low emissions of pollutants, particularly low $NO_x$ emissions and CO emissions at all power conditions;

This invention further provides fuel injector systems for gas turbine engines having superior lean blowout performance;

This invention still further provides fuel injector systems designed to operate at the high power conditions of advanced gas turbine engines without thermal damage to the fuel injector itself; and In various other exemplary embodiments according to this invention, a fuel injector system that reduces and/or eliminates combustion instability includes a pilot fuel injector, a pilot swirler that swirls air past the pilot fuel injector, a main airblast fuel injector having an aft end, inner and outer main swirlers that swirl air past the main airblast fuel injector, and an air splitter located between the pilot swirler and the inner main swirler. The air splitter includes at least one aft end arm/cone angled radially outboard and axially positioned downstream of the main airblast fuel injector aft end. The air splitter divides a pilot air stream exiting the pilot swirler from an inner main air stream exiting the inner main swirler to create a bifurcated recirculation zone.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods of this invention described in detail below, with reference to the attached drawing figures, in which.

DETAILED DESCRIPTION OF PREFERRED EMBODIMENTS

One of the mechanisms forcing the combustion instability is the modulation of equivalence ratio at the flamefront, caused by a modulation of the inner airstream as the combustor pressure fluctuates. This determination is based on numerical predictions in which the predicted instability is dampened when the airflow in the inner main airstream is held constant at the swirl vane exit.

Figure 1:
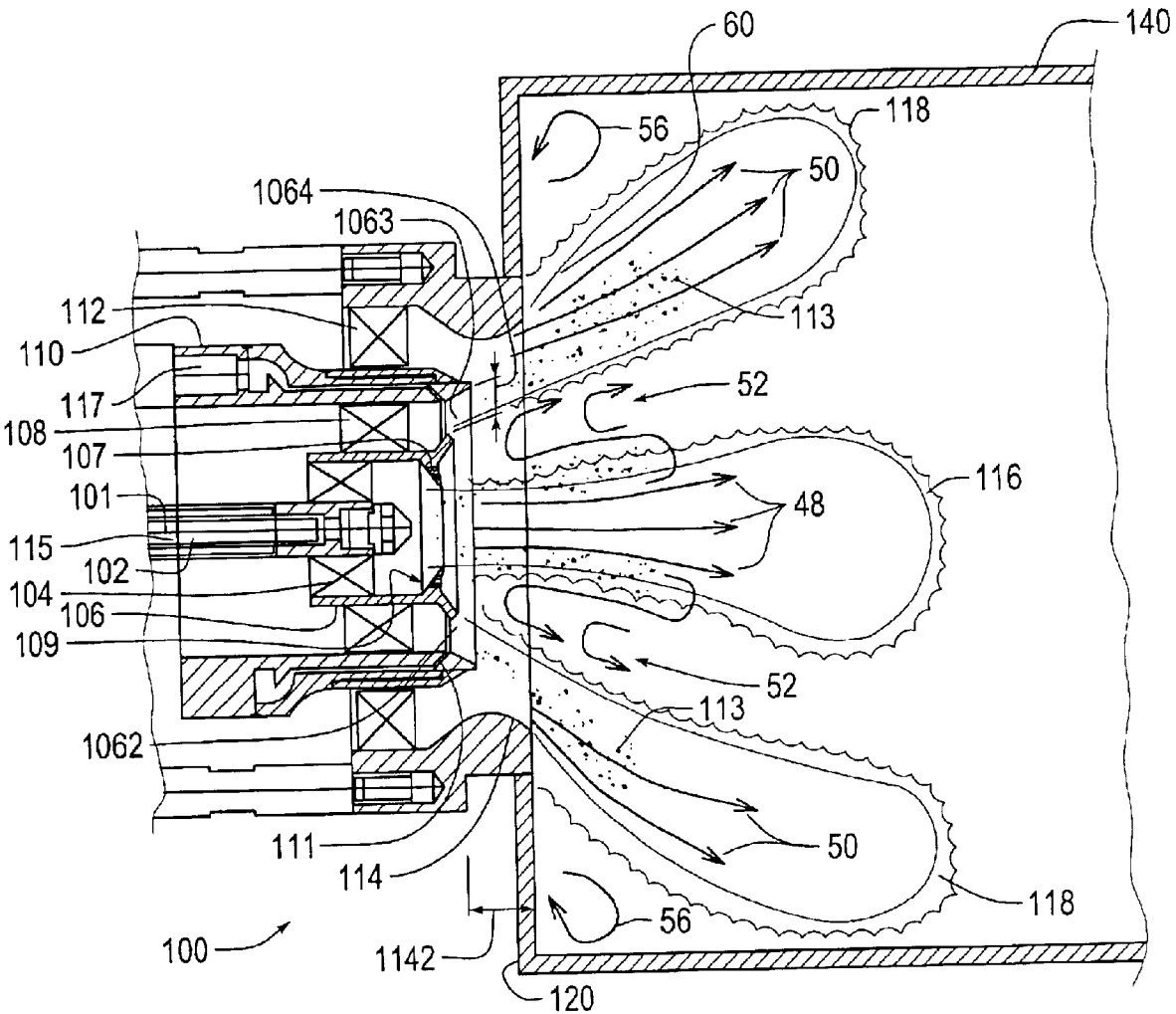
FIG. 1 is a cross-sectional schematic view of one exemplary embodiment of a piloted airblast fuel injector system with a modified air splitter according to this invention.
Figure 2:
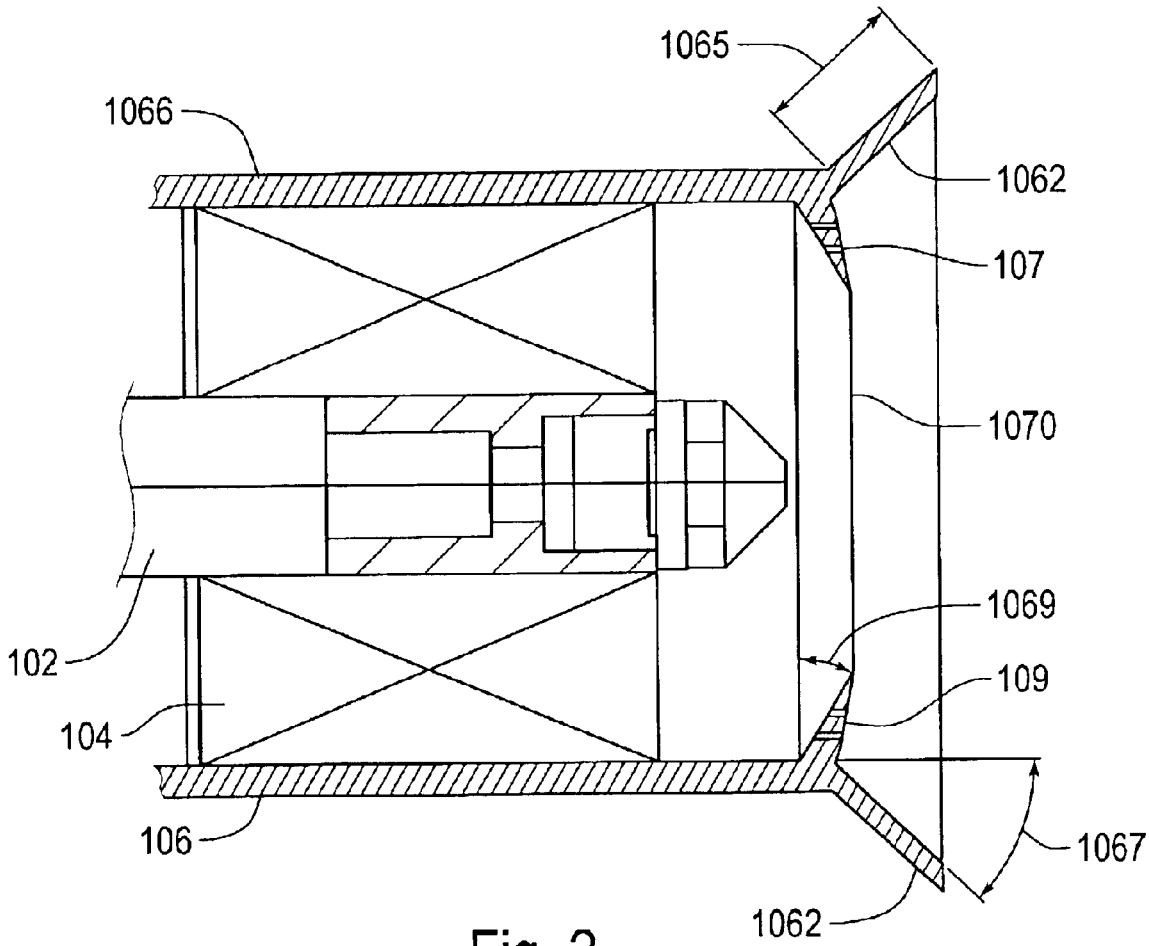
FIG. 2 is a detailed cross-sectional schematic view of the piloted airblast fuel injector with a modified air splitter of FIG. 1.

FIG. 1 shows a cross-sectional schematic view of one exemplary embodiment of a piloted airblast fuel injector system 100 with a modified air splitter according to this invention. FIG. 2 shows in more detail the modified air splitter region of the piloted airblast fuel injector system of FIG. 1. The piloted airblast fuel injector system 100 includes three air passages and two fuel injectors. The piloted airblast fuel injector system 100 is mounted upon the dome wall 120 of a combustor 140 of a gas turbine engine.

As shown in FIGS. 1 and 2, in one exemplary embodiment, the piloted airblast fuel injector system 100 includes a pilot fuel injector 102 located on the centerline 101 of the piloted airblast fuel injector system 100. A pilot swirler 104, used to swirl air past the pilot fuel injector 102, surrounds the pilot fuel injector 102. The pilot swirler 104 shown in the exemplary embodiment is an axial type pilot swirler 104. In general, the pilot swirler 104, and any of the other swirlers, can be either radial or axial swirlers, and may be designed to have a vane-like configuration.

The piloted airblast fuel injector system 100 utilizes a pilot fuel injector 102 of the type commonly referred to as a simplex pressure atomizer fuel injector. As will be understood by those skilled in the art, the simplex pressure atomizer fuel injector 102 atomizes fuel based upon a pressure differential placed across the fuel, rather than atomizing fuel with a rapidly moving air stream as do airblast atomizers.

The piloted airblast fuel injector system 100 further includes a main airblast fuel injector 110 which is concentrically located about the simplex pressure atomizer pilot fuel injector 102. Inner and outer main swirlers 108 and 112 are located concentrically inward and outward of the main airblast fuel injector 110. The simplex pressure atomizer pilot fuel injector 102 and main fuel injector 110 may also be described as a primary fuel injector 102 and a secondary fuel injector 110, respectively.

As it will be appreciated by those skilled in the art, the main airblast fuel injector 110 provides liquid fuel to an annular aft end 111 which allows the fuel to flow in an annular film. The annular film of liquid fuel is then entrained in the much more rapidly moving and swirling air streams passing through inner main swirler 108 and outer main swirler 112, which air streams cause the annular film of liquid fuel to be atomized into small droplets which are schematically illustrated and designated by the numeral 113. Preferably, the design of the airblast main fuel injector 110 is such that the main fuel is entrained approximately mid-stream between the air streams exiting the inner main swirler 108 and the outer main swirler 112.

In the inner and outer main swirlers 108 and 112 have a vane configuration, the vane angles of the outer main swirler 112 may be either counter-swirl or co-swirl with reference to the vane angles of the inner main swirler 108.

The fuel injection system 100 further includes a modified air splitter 106, and a flared aft outlet wall 114. The air splitter 106 is located between the pilot swirler 104 and the inner main swirler 108. The geometry of and location of the air splitter 106 is such that the air splitter divides a pilot air stream exiting the pilot swirler 104 from a main air stream exiting the inner and outer main swirlers 108 and 112, whereby a bifurcated recirculation zone 52 is created between the pilot air stream and the main air stream.

As shown in FIGS. 1 and 2, the air splitter 106 includes at least one aft end arm/cone 1062 angled radially outboard and axially positioned downstream of the main airblast fuel injector 110 aft end. The air splitter cone 1062 constricts the inner main air stream at a location 1063 close to or downstream of the location where the main fuel is injected. The inner main air constriction 1064 created by the air splitter cone 1062 reduces or prevents the inner main air stream from modulating with combustor pressure fluctuations.

In various exemplary embodiments, the air splitter cone 1062 is made to have a length 1065 as short as possible, as based on design constraints, manufacturing considerations and the like. Further, the air splitter cone 1062 is angled radially outboard relative to a wall 1066 of the air splitter 106. In various exemplary embodiments, the air splitter cone 1062 is angled at an angle 1067 in a range of about 45° to about 75°. In an exemplary embodiment, the air splitter cone 1062 is angled at an angle 1067 of about 60° relative to the wall 1066 of the air splitter 106.

In various exemplary embodiments, the air splitter 106 is manufactured of a high temperature metal. Because of the high temperature and/or high pressure environment in which it operates, the air splitter 106 may have thermal barrier coating layer, such as a ceramic layer, applied on its surface.

As shown in FIG. 1, the bifurcated recirculation zone is generally indicated in the area at 52. It will be appreciated by those skilled in the art that the bifurcated recirculation zone 52 is a generally hollow conical aerodynamic structure which defines a volume in which there is some axially rearward flow. This bifurcated recirculation zone 52 separates the pilot airflow discharging from the injector 102 as designated by arrows 48 from the main airflow discharging from the injector 110 as designated by the arrows 50. It is noted that there is no central recirculation zone, i.e. no reverse flow along the central axis 101 as would be found in conventional fuel injectors.

The creation of the bifurcated recirculation zone which aerodynamically isolates the pilot flame from the main flame benefits the lean blowout stability of the fuel injector. The pilot fuel stays nearer to the axial centerline and evaporates there, thus providing a richer burning zone for the pilot flame than is the case for the main flame. The fuel/air ratio for the pilot flame remains significantly richer than that for the main flame over a wide range of operating conditions. Most of the NOx formation occurs in this richer pilot flame, and even that can be further reduced by minimizing the proportion of total fuel going to the pilot flame.

The selection of design parameters to create the bifurcated recirculation zone 52 includes consideration of the diameter of the outlet 1070 of air splitter 106, vanes 104 and the deflection angle of swirl 1069 (shown in FIG. 2) imparted to the airflow flowing therethrough. As will be appreciated by those skilled in the art, the greater the angle of swirl, the greater the centrifugal effect, and thus increasing swirl angle will tend to throw the pilot airflow further radially outward. The tapered design of the air splitter 1069, on the other hand, tends to direct the pilot airflow mixture radially inward. The combination of these two will determine whether the desired bifurcated recirculation zone is created. Also, the amount of pilot airflow through the fuel injector is controlled mainly by the diameter of the outlet 1070 and the angle of swirl through the outlet. If the percentage of pilot airflow is too low (less than two percent, for example), the main airflow will dominate and may produce a central recirculation zone. If the outlet opening 1070 is too small or if too great a swirl angle is provided to the pilot air flow, then the pilot airflow will be thrown too far radially outward so that it merges with the main fuel air flow, which will in turn create a conventional central recirculation rather than the desired bifurcated recirculation. In general, for designs like those illustrated, the swirl angle of the pilot air stream should be less than about 30 degrees.

To further describe the various flow regimes within the combustor 140, the radial outer flow stream lines of the flow from the main airblast injector 110 are designated by arrows 50. Also, there are corner recirculation zones in the forward corners of combustor 140 indicated by arrows 56.

The outer flow streamlines of the fuel and air flowing from the main airblast injector 110 and inner and outer main swirlers 108 and 112 is further affected by the presence of an aft flared wall 114 downstream of the main airblast fuel injector 110. The flare of aft flared wall 114 ends at an angle 60 to the longitudinal axis 101 which is preferably in the range of from about 45° to 70°.

The outwardly flared outer wall 114 has a length 1142 from the aft end of main airblast injector 110 to an aft end of the outer wall 114 sufficiently short to prevent autoignition of fuel within the outer wall 114. The length 1142 may also be described as being sufficiently short to prevent fuel from the main fuel injector 110 from wetting the flared outer wall 114. In a typical embodiment of the invention, the length 1142 will be on the order 0.2 to 0.3 inch.

The short residence time in the flared exit precludes autoignition within the nozzle. Significant evaporation and mixing does occur within the flared outlet, even for such a short residence time. The partial pre-mixing improves fuel/air distribution and reduces NOx. The extension combined with the flared exit also results in a larger stronger bifurcated recirculation zone 52.

As noted, the swirlers 104, 108 and 112 schematically illustrated in FIG. 1 each include axial swirl vanes which are straight. In alternative embodiments, swirlers 104, 108 and 112 may be provided with curved vanes. The curved axial swirl vanes are provided to reduce the Sauter Mean Diameter of the main fuel spray from the main airblast injector 110 as compared to the Sauter Mean Diameter that would be created when utilizing straight vanes.

It will be appreciated that in a typical fuel injection system 100, all three swirlers 104, 108 and 112 are fed from a common air supply system, and the relative volumes of air which flow through each of the swirlers are dependent upon the sizing and geometry of the swirlers and their associated air passages, and the fluid flow restriction to flow through those passages which is provided by the swirlers and the associated geometry of the air passages. In one exemplary embodiment, the swirlers and passage heights are constructed such that from 5 to 20 percent of total swirler air flow is through the pilot swirler 104, from 30 to 70 percent of total air flow is through the inner main swirler 108 and the balance of total air flow is through the outer main swirler 112.

When utilizing the simplex pressure atomizer pilot fuel injector, the atomizer should be selected with a high spray angle to inject spray into the bifurcated recirculation zone, but not so high as to impinge onto the air splitter 106.

In FIG. 1, a pilot fuel supply line 115 is shown providing fuel to the pilot fuel injector 102, and a main fuel supply line 117 is shown providing fuel to the main airblast injector 110.

Figure 3:
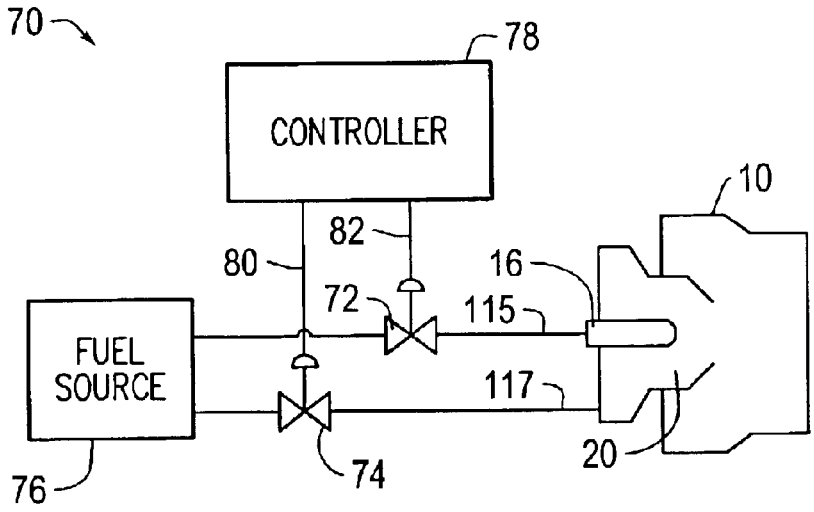
FIG. 3 is a schematic illustration of an exemplary embodiment of a fuel flow control system utilized with this invention.
Figure 4:
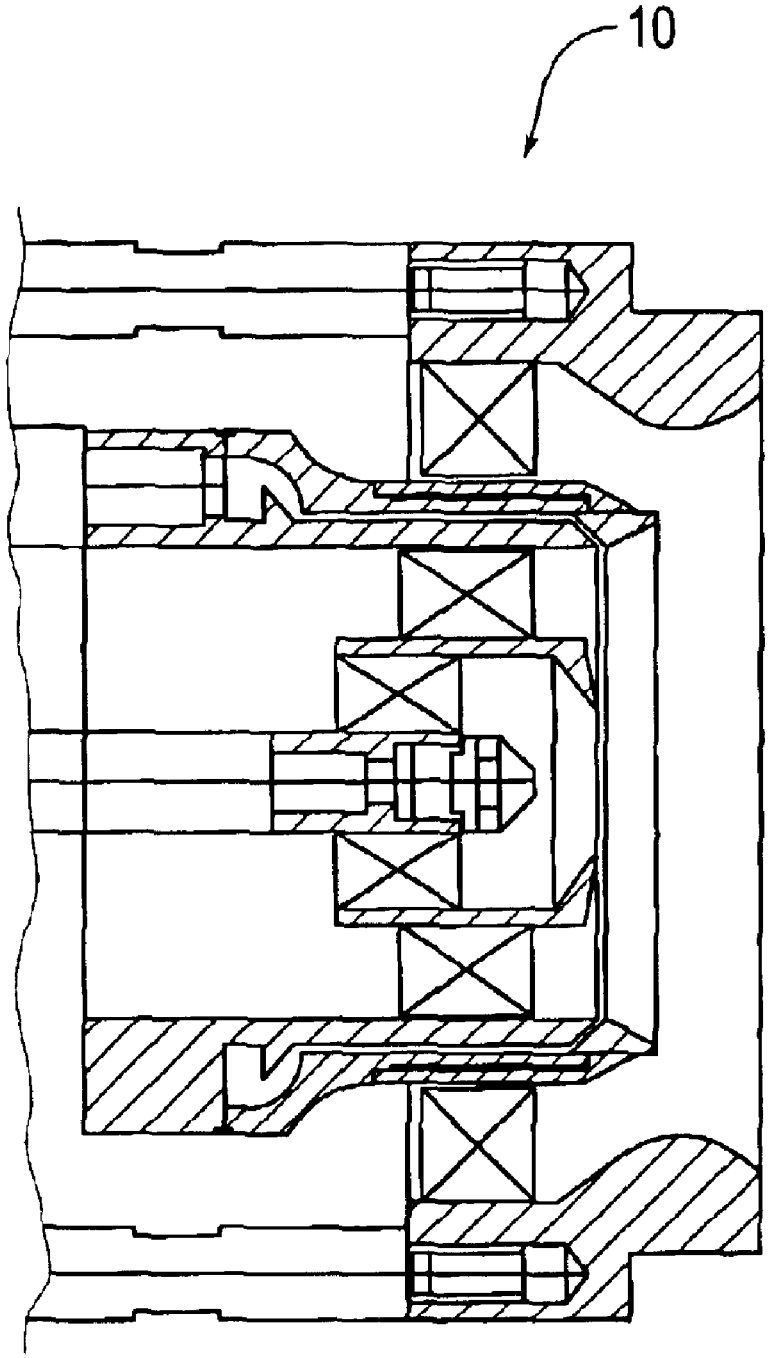
Fig. 4 Related Art
FIG. 4 is a schematic illustration of a LDI fuel injector with a conventional air splitter.

FIG. 3 schematically illustrates a fuel supply control system 70 utilized with the fuel injector like the fuel injector system 100 of FIG. 1. The fuel supply control system 70 includes control valves 72 and 74 disposed in the pilot and main fuel supply lines 115 and 117, which supply lines lead from a fuel source 76. A microprocessor based controller 78 sends control signals over communication lines 80 and 82 to the control valves 72 and 74 to control the flow of fuel to pilot fuel injector 102 and main fuel injector 110 in response to various inputs to the controller and to the pre-programmed instructions contained in the controller. In general, during low power operation of the gas turbine associated with the fuel injection system 100, fuel will be directed only to the pilot fuel injector 102, and at higher power operating conditions, fuel will be provided both to the pilot fuel injector 102 and the main airblast fuel injector 110.

During low power operation of the fuel injector 100, fuel is provided only to the pilot fuel injector 102 via the pilot fuel supply line 115. The fuel is atomized into the small droplets. The swirling motion of the air streams from the pilot swirler 104 causes the pilot fuel droplets to be centrifuged radially outwardly so that many of them are entrained within the bifurcated recirculating flow zone 52. This causes the pilot flame to be anchored within the bifurcated recirculation zone 52.

At higher power operation of the fuel injector 100, fuel is also injected into the main airblast injector 110 via the main fuel line 117. The main fuel droplets 113 are entrained within the air flow between air stream lines of the outer and inner main swirlers 108 and 112.

The air flow which flows through the swirlers 104, 108 and 112 preferably is divided in the proportions previously described. As this air flow flows past the air splitter 106, the main air flow passing through main swirlers 108 and 112 is split away from the pilot air flow which flows through swirler 104 and which must flow through the air splitter 106 and exit the outlet 1070 thereof, thus creating the bifurcated recirculation zone 52 which separates the main air flow from the pilot air flow within the combustor 140.

FIG. 1 also includes a schematic representation of the shape of both a pilot flame 116 and a main flame 118 at full power conditions and a 10/90 pilot/main fuel flow split. As previously noted, the pilot flame 116 is anchored by and generally contained within the bifurcated recirculation zone 52. The pilot flame generally has a yellow color in its radial and axially aft extremities and a generally blue color in its axially forward axial portion. The main flame 118 is generally blue in color. In general, blue flames are fuel-lean flames, and are a necessary, but not sufficient, condition of low NOx emissions. This is because lean flames can still have local stoichiometry (fuel-to-air ratio) that approaches stoichiometric values and the hottest possible temperatures. The ideal situation (for lowest NOx emissions) would be for the main fuel to entirely prevaporize and premix with the main airflow before reaction occurs, thus producing a uniform stoichiometry and lowest possible flame temperatures. Although fuel/air uniformity is desired, many factors can influence how closely uniform stoichiometry is achieved in the real application, e.g. circumferential fuel uniformity, vane wakes from the swirlers, airfeed uniformity into the swirlers, etc.

Yellow flames are always indicative of fuel-rich flames, and stoichiometric flames somewhere in the flowfield. This type of flame is to be expected (and desired) for the pilot flame in order to minimize the fuel-to-air ratio of the fuel injector at lean blowout. Since only approximately 10 percent of the total fuelflow enters the pilot at full power conditions, the amount of NOx produced by the pilot flame is somewhat limited. If possible, the amount of pilot fuel should be reduced at full power conditions to minimize NOx emissions; however, at low pilot fuelflows, one must be concerned about carbon deposition within the pilot fuel circuit. For minimum full power NOx, pilot fuel flow can be eliminated if purging is performed.

As seen in FIGS. 1 and 2, the air splitter 106 may have small diameter holes 107, in the range of 0.010 to 0.060 inch diameter placed around the tapered end portion, and spaced from 2 to 8 hole diameters apart, to improve durability of the splitter 106 and to eliminate carbon formation on the downstream face 109 of the splitter.

Although the invention has been described in detail, it will be apparent to those skilled in the art that various modifications may be made without departing from the scope of the invention.

What is claimed is:

1. A fuel injection system for a gas turbine, comprising:

a pilot fuel injector;

a pilot swirler that swirls air past the pilot fuel injector;

a main airblast fuel injector having an aft end;

inner and outer main swirlers that swirl air past the main airblast fuel injector; and an air splitter located between the pilot swirler and the inner main swirler, the air splitter comprising at least one aft end cone angled radially outboard and axially positioned close to or downstream of the main airblast fuel injector aft end, the air splitter dividing an outer pilot air stream exiting the pilot swirler from an inner main air stream exiting the inner main swirler to create a bifurcated recirculation zone.

2. The fuel injection system of claim 1, wherein the pilot fuel injector is an axially located pressure atomizer.

3. The fuel injection system of claim 1 further comprising a fuel supply control system for providing fuel only to the pilot fuel injector at lower power conditions, and for providing fuel to both the pilot fuel injector and the main airblast fuel injector at higher power conditions.

4. The fuel injection system of claim 1, wherein the swirlers are constructed such that from about 5% to about 20% of total airflow is through the pilot swirler, from about 30% to about 70% of total airflow through the swirlers is through the inner main swirler, and the balance of total airflow is through the outer main swirler.

5. The fuel injection system of claim 1, wherein the at least one aft end cone is angled radially outboard at an angle in a range of about 45° to about 75° relative to a wall of the air splitter.

6. The fuel injection system of claim 1, wherein the at least one aft end cone is angled radially outboard at an angle about 60° relative to a wall of the air splitter.

7. The fuel injection system of claim 1, wherein the at least one aft end cone is axially positioned at or downstream of main airblast fuel injector aft end.

8. The fuel injection system of claim 1, wherein the air splitter is made of a high temperature metal.

9. The fuel injection system of claim 8, wherein the air splitter has a thermal barrier coating layer applied thereon.

10. The fuel injection system of claim 9, wherein the thermal barrier coating layer comprises a ceramic material.

11. The fuel injection system of claim 1, wherein the air splitter cone is arranged to constrict an inner main air stream at a location downstream of a main fuel injection location.

12. A fuel injector apparatus for a gas turbine, comprising:

an axially located fuel injector;

a first swirler located concentrically about the axially located fuel injector;

a second swirler located concentrically about the first swirler;

a third swirler located concentrically about the second swirler;

an airblast fuel injector located concentrically between the second and third swirlers; and an air splitter located concentrically between the first and second swirlers, the air splitter comprising at least one outboard cone axially positioned downstream of an aft end of the main airblast fuel injector.

13. The fuel injector apparatus of claim 12, wherein the swirlers are constructed such that from about 5% to about 20% of total airflow is through the first swirler, from about 30% to about 70% of total airflow through the swirlers is through the second swirler, and the balance of total airflow is through the third swirler.

14. The fuel injector apparatus of claim 12 further comprising a fuel supply control system for providing fuel only to the axially located injector at lower power conditions, and for providing fuel to both the axially located injector and the airblast fuel injector at higher power conditions.

15. The fuel injection system of claim 12, wherein the at least one outboard cone is angled radially outboard at an angle in a range of about 45° to about 75° relative to a wall of the air splitter.

16. The fuel injection system of claim 12, wherein the at least one outboard cone is angled radially outboard at an angle about 60° relative to a wall of the air splitter.

17. The fuel injection system of claim 12, wherein the at least one outboard cone is axially positioned downstream of the airblast fuel injector aft end.

18. The fuel injection apparatus of claim 12, wherein the axially located fuel injector is a pressure atomizer fuel injector.

19. A method of injecting fuel into a gas turbine, comprising:

injecting a pilot fuel stream;

injecting a main fuel stream concentrically about the pilot fuel stream;

providing a swirling pilot air stream to entrain the pilot fuel stream;

providing a swirling main air stream to entrain the main fuel stream; and splitting the pilot air stream from the main air stream and creating a bifurcated recirculation zone between the pilot air stream and the main air stream, the swirling main air stream being constricted at a location where the main fuel stream is injected into the gas turbine.

20. The method of claim 18, wherein splitting the pilot air stream from the main air stream and creating a bifurcated recirculation zone further includes avoiding creation of a central recirculation zone.

21. The method of claim 18, wherein constricting the swirling main air stream at the location where the main fuel stream is injected into the gas turbine reduces or prevents the swirling main air stream from modulating with combustor pressure changes.

22. A fuel injection system for a gas turbine, comprising:

an axially located fuel injector;

a first swirler located concentrically about the axially located fuel injector;

a second swirler located concentrically about the first swirler;

a third swirler located concentrically about the second swirler;

a airblast fuel injector located concentrically between the second and third swirlers;

an air splitter located concentrically between the first and second swirlers, the air splitter having an aft end, and at the aft end a first cone angled radially outboard and a second cone angled radially inboard; and at least one passage for air positioned radially between an aft end of the first cone and an aft end of the second cone.

* * * * *